United States Patent [19]

Bhagwat

[11] Patent Number: 4,538,799

[45] Date of Patent: Sep. 3, 1985

[54] SHEET FEEDING APPARATUS

[75] Inventor: Anil G. Bhagwat, Hemel Hempstead, England

[73] Assignee: Xerox Corporation, Stamford, Conn.

[21] Appl. No.: 534,054

[22] Filed: Sep. 20, 1983

[30] Foreign Application Priority Data

Sep. 21, 1982 [GB] United Kingdom ..... 8226807

[51] Int. Cl.[3] ..... B65H 1/26; B65H 3/06

[52] U.S. Cl. ..... 271/9; 271/117; 271/164

[58] Field of Search ..... 271/9, 34, 38, 111, 271/117, 118, 157, 158, 159, 160, 162, 164, 170

[56] References Cited

U.S. PATENT DOCUMENTS

| | | | |
|---|---|---|---|
| 3,288,460 | 11/1966 | Eichorn | 271/170 X |
| 3,599,966 | 8/1971 | Del Vecchio | 271/9 |
| 3,689,064 | 9/1972 | Kuksa | 271/164 |
| 3,843,115 | 10/1974 | Di Fulvio et al. | 271/164 X |
| 4,108,427 | 8/1978 | Komori et al. | 271/9 |

OTHER PUBLICATIONS

Collins, J. M., "Sheet Feeder", Xerox Disclosure Journal, vol. 1, Nos. 11/12, Nov./Dec. 1976, p. 53.

*Primary Examiner*—Bruce H. Stoner, Jr.
*Assistant Examiner*—Lawrence J. Goffney, Jr.
*Attorney, Agent, or Firm*—William A. Henry, II

[57] ABSTRACT

A sheet feeding apparatus for a copying machine includes two sheet trays and a frictional feeding device in a fixed location for top-feeding sheets from either one of the stacks. The trays are carried one above another by a tray carriage and are arranged for independent slideable withdrawal from the tray carriage towards the front of the machine. The tray carriage is mounted for vertical movements, and the upper tray is slideably mounted on a sub-frame for movements thereover in the sheet feed direction, i.e. across the machine, so that the top sheet in either one of the two trays may be brought into feeding engagement with the feeder device.

3 Claims, 4 Drawing Figures

11
12
11
35
10
34
33
15
13
44
16
18
19
14
17
31
27
1
2
32
30
21
26
39
29
28
22
27
38
36
23
37
20
24
40
25
41
43
42

SHEET FEEDING APPARATUS

BACKGROUND OF THE INVENTION

1. Field of the Invention

This invention relates to a sheet feeding apparatus. The apparatus is of the kind which includes a plurality of sheet holders for holding respectively a plurality of stacks of sheets, and a frictional feeder device in a fixed location for top-feeding sheets from any selected one of the stacks.

2. Brief Description of the Prior Art

An apparatus of this general kind is described in U.S. Pat. No. 4,108,427, which is concerned with a sheet feeding apparatus for a copying machine in which sheets from either one of two cassettes are fed by a common feed roller. The cassettes are held in casette receivers which are rigidly secured to a cassette cradle. The cassette cradle is mounted on the machine frame by pivotal links, and may be moved in an arcuate fashion to bring the top sheet in either one of the cassettes into feeding engagement with the feed roller. Throughout the feeding operation and during the change over from one cassette to the other, the cassettes remain in fixed positions relative to one another. In order to re-load a cassette with a fresh supply of sheets, it is removed from the machine, loaded, and replaced in the machine. The cassette has inside it an intermediate plate for supporting the stack of sheets, the plate being spring-urged upwards to maintain the top sheet in the stack in the correct position for feeding.

With a sheet feeding apparatus of the kind just described, it is necessary to provide access to the cassettes so that they can be re-loaded or changed. This is done in U.S. Pat. No. 4,108,427 by allowing substantial portions of the cassettes to protrude out of the side of the machine.

A more compact machine can be provided, without the need for removing cassettes and relocating them in their proper places, by providing sheet trays that do not need to be taken out of the machine like the cassettes described above, but which can be withdrawn, on slides or runners, for re-loading.

SUMMARY OF THE INVENTION

It is an object of the present invention to provide an arrangement of the kind contemplated in the previous paragraph, in which the sheet trays make simple, linear, motions in the horizontal and vertical directions, and in which the vertical motion can be utilised to bring the top sheet of the stack from which sheets are being fed into feeding engagement with the feeder device.

The present invention provides a sheet feeding apparatus in which the sheet holders comprise tray assemblies which are carried one above another by a tray carriage and which are arranged for independent slideable withdrawal from the tray carriage in a first horizontal direction. The tray carriage is mounted for vertical movements, and each, or each but the lowermost, of the tray assemblies comprises a sub-frame and a tray, the tray being slideably mounted on the sub-frame for movements thereover in a second direction parallel with the sheet feed direction and perpendicular to the first horizontal direction.

It is a further object of the invention to provide a simple, compact arrangement, internally of its associated machine, such as a copying machine, with easy re-loading from the front of the machine.

Other objects and features of the invention will become apparent from the following description of a preferred embodiment with reference to the accompanying drawings.

DESCRIPTION OF A PREFERRED EMBODIMENT

Figure 1:
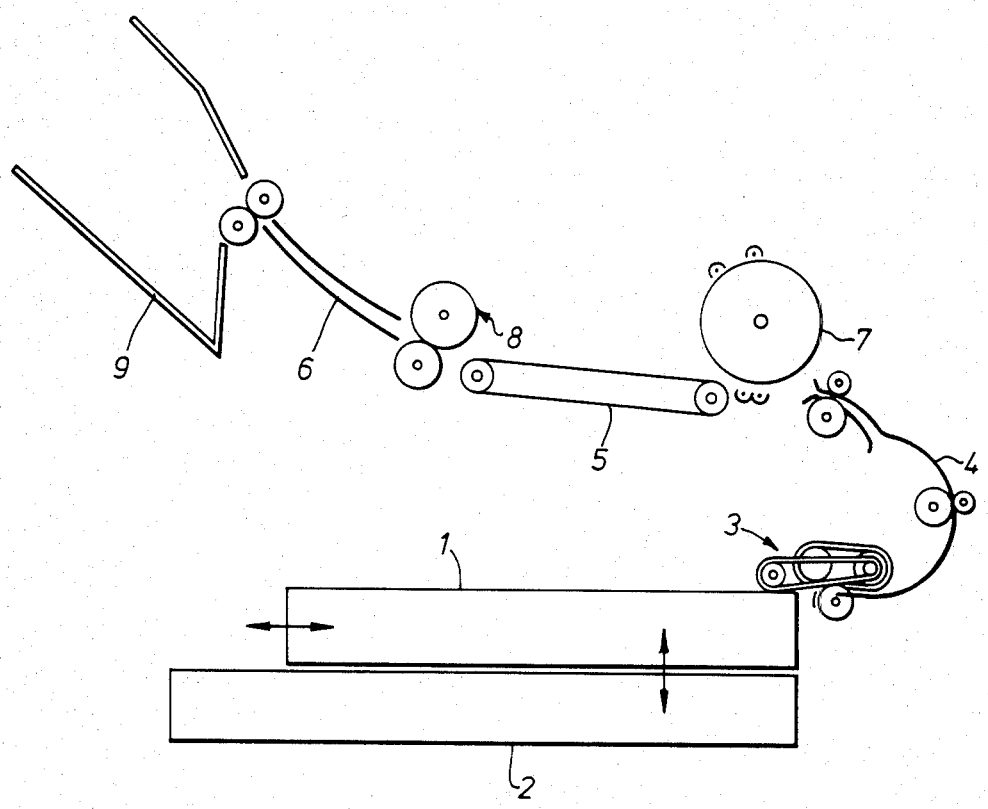
FIG. 1 is a schematic side elevation of the essential elements which form the sheet path of paper sheets fed through a xerographic copying machine which incorporates the sheet feeding apparatus of the invention.

Referring to FIG. 1, the main components of the paper supply sub-system of a xerographic copying machine are, as indicated diagramatically, the main paper tray 1, the auxiliary paper tray 2, the paper feeder 3, the outer guide 4, the pre-fuser transport 5, and the output guides 6. Paper sheets are fed from either one of the paper trays 1, 2 by means of a common paper feeder 3 of the friction retard type. The feeder is stationary, and the selected tray is moved into a sheet-feeding position.

Paper is fed from either the main tray 1 or the auxiliary tray 2. The auxiliary tray is of larger size than the main tray, enabling a wider choice of paper sizes and types to be fed from it. The trays are physcially located in the lower part of the machine below the photoreceptor drum 7.

Having been fed from a tray, the sheet is moved around the outer guide, which turns the sheet over and stops its leading edge at a registration position. When the sheet is called for to receive the toner image from the photoreceptor drum 7, it is fed into contact with the drum. After it has received the toner images, the sheet is fed by the pre-fuser transport 5, which is a vacuum belt transport arrangement, to the fuser 8. From the fuser, the sheet is delivered through the output guides 6 to a catch tray 9.

The paper trays will now be described in more detail with reference to FIGS. 2 and 3. The paper trays, indicated generally as a main tray 1 and an auxiliary tray 2, are mounted on a tray carriage 10. As indicated by the broken lines on FIG. 2, the main tray 1 is the upper tray and the auxiliary tray 2 is the lower tray.

Figure 2:
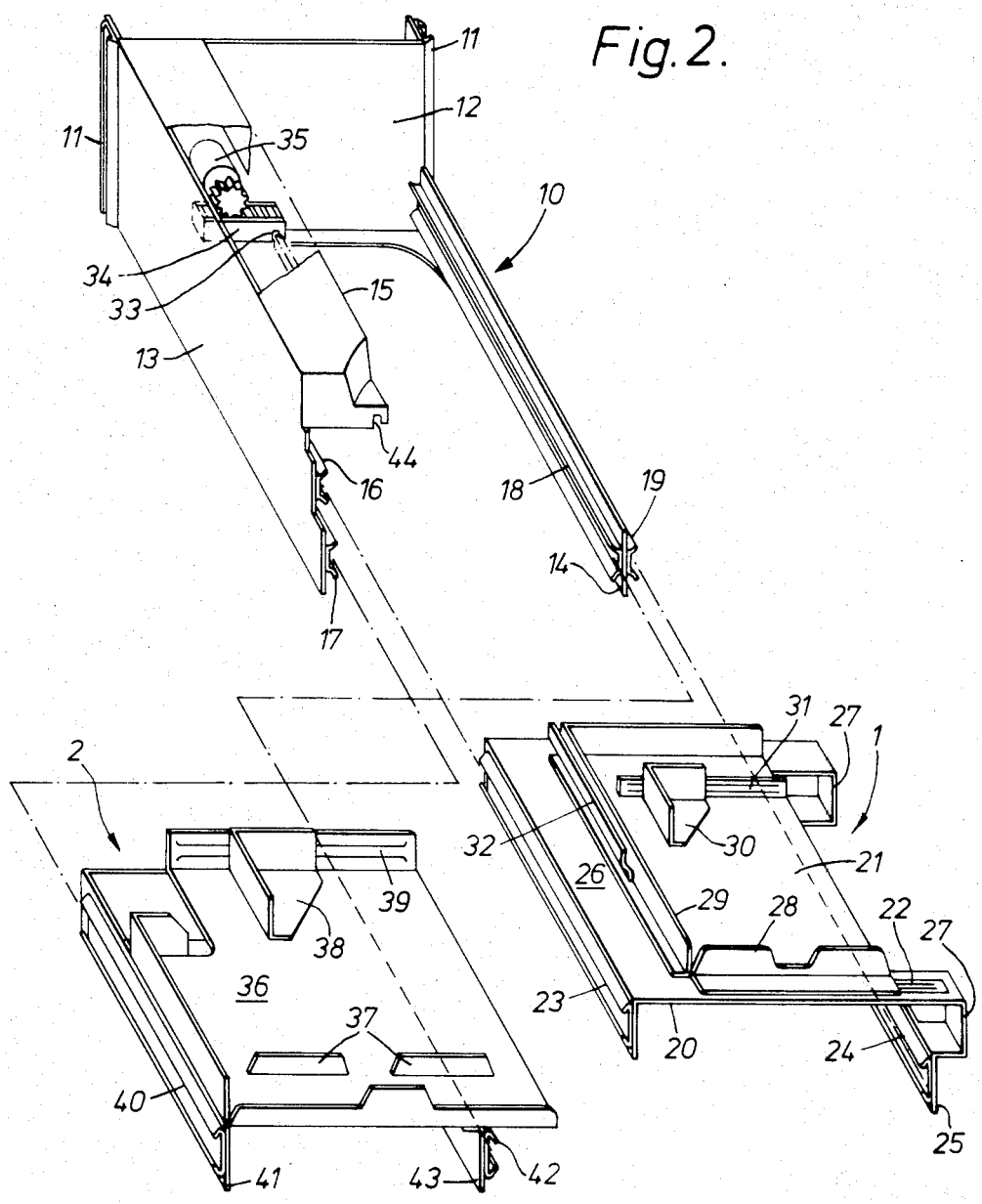
FIG. 2 is an exploded perspective view of the sheet tray assemblies of the apparatus of the invention, together with their carriage.

The tray carriage 10 is supported entirely by means of vertical ball slides 11, the moving parts only of which are shown in FIG. 2, the cooperating, fixed, parts being mounted on the rear frame of the machine. The ball slides 11 allow the tray carriage to move vertically up and down as will be described in more detail later (with reference to FIG. 3).

The tray carriage 10 consists of a vertical rear plate 12, a left-hand side plate 13, and a right-hand side plate 14. The left-hand side plate 13 carries a box-like container 15 along the upper part of the tray carriage 10, for housing electrical components, including an electric motor. An upper left-hand slide rail 16 and a lower left-hand slide rail 17 are mounted below the container 15, and extend from front to rear of the left-hand side plate 13.

The right-hand side plate 14 carries an inner right-hand slide rail 18 and an outer right-hand slide rail 19 which both extend from front to rear of the right-hand side plate 14, and are both at the same height as the lower left-hand slide rail 17.

The main tray 1 comprises a main tray sub-frame 20 and a main paper tray 21. The main paper tray 21 is mounted for left-to-right sliding movement over the main tray sub-frame 20 by means of a ball slide 22 at the front of the tray, the rear part of the paper tray 21 sliding over nylon studs (not shown) in the sub-frame 20. The sub-frame 20 carries, on a downward extension of its left-hand edge, a left-hand slide 23, for cooperation with the upper left-hand rail 16 of the tray carriage 10, and a right-hand slide 24, for cooperation with the outer right-hand rail 19. Since the outer right-hand rail 19 is lower than the upper left-hand rail 16, a support plate 25 is provided for the right-hand slide 24, mounted below the base plate 26 of the main tray sub-frame 20 by means of extension pieces 27.

The main paper tray 21, which feeds paper to the right, has an upstanding front wall 28 and a left-hand side wall 29. A movable corner piece 30 is mounted for left to right sliding movement on a slide 31. On the left-hand side wall 29, an elongated catch member 32 is formed, with an upstanding outer portion that extends from about the mid-portion to the rear end portion of the side wall 29. The upstanding outer portion of the catch member 32 is for engagement with a notch 33 in a rack 34 that is mounted for sliding left-to-right movements in the container 15. The rack is engaged by a pinion that is driven by a motor 35. When the main tray 1 is in the 'home' position in the tray carriage 10, i.e. when it has been slid to the rear of the carriage 10 as far as it will go, the upstanding outer portion of catch member 32 engages in notch 33, enabling the motor 35 to drive the paper tray 21 to the left or the right.

In order to prevent the main paper tray 21 from moving to the right other than when it is in its 'home' position, a groove 44 is formed along the right hand vertical side of the container 15. Groove 44 extends from the front of the container 15 to a point approximately midway between the front and rear of container 15, terminating just in front of the rack 34. The upstanding portion of catch member 32 and the groove 44 are arranged such that during withdrawal and re-insertion of the main tray 1, catch member 32 and groove 44 are slidingly interlocked. Once the main tray 1 is fully home, however, catch member 32 has passed completely through groove 44, and is engaged only by notch 33 of rack 34.

The auxiliary tray 2 includes a platform 36 for supporting copy paper sheets between upstanding front plates 37 and a slideable corner piece 38. Corner piece 38 is arranged for left-to-right sliding on slide 39. A left-hand slide 40 is carried by a downwardly extending side plate 41 at the left-hand edge of the platform 36, and a right-hand slide 42 is carried by a downwardly extending plate 43 mounted inwardly of the right-hand edge of platform 36. Left-hand slide 40 cooperates with the lower left-hand rail 17 of the tray carriage 10, and right-hand slide 42 cooperates with the inner right-hand rail 18 of carriage 10.

Figure 3:
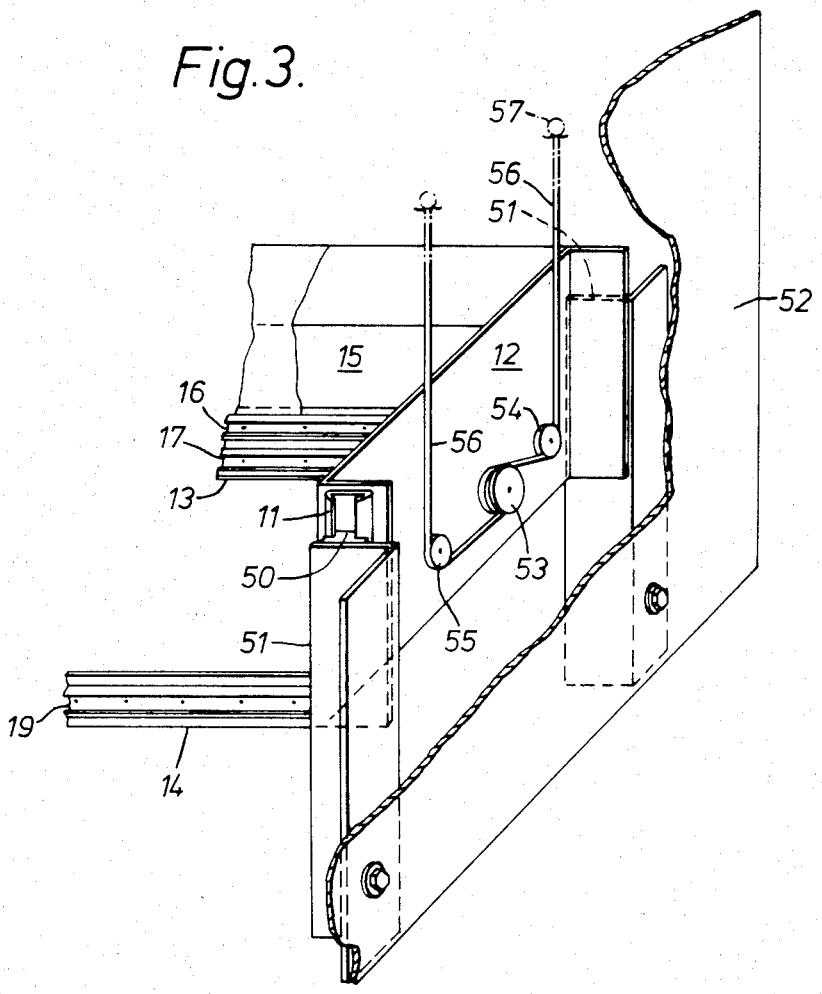
FIG. 3 is a partial perspective view of the rear portion of the carriage.

Referring to FIG. 3, the vertical slides 11 cooperate with rails 50 that are secured by angled members 51 to the rear frame 52 of the machine. Mounted on the rear panel 12 of the carriage 10 are a capstan 53, driven by a motor (not shown) on the front side of rear panel 12, and two pulleys 54, 55. A cable 56 is secured at one end by an anchorage 57 on the machine frame, generally vertically above the highest point reached by the pulley 54. The cable passes around pulley 54, is wound around capstan 53, passes around pulley 55, and is anchored to the machine frame in the same way as the other end. On energising the motor to turn capstan 53, the carriage 10 is elevated or lowered as the cable winds onto or off the capstan.

Copy paper sheets can be fed out from either tray at the choice of the operator. If sheets are to be fed from the main tray, the main paper tray 21 is moved to the right of FIG. 2 over the main tray sub-frame 20 by means of motor 35. The tray carriage 10 is elevated to bring the top right-hand edge of the stack of sheets in the main paper tray 21 into the feeding position relative to the paper feeder 3, i.e. into the position indicated diagramatically in FIG. 1. If sheets are to be fed from the auxiliary tray, the main tray 21 is moved to the left over the main tray sub-frame 20, and the tray carriage 10 is elevated to bring the top right-hand edge of the stack of sheets in the auxiliary paper tray 2 into the feeding position. In order to change back to the main tray, the tray carriage 10 is lowered, the main tray is moved again to the right, and the tray carriage 10 is elevated again.

When replenishment of either tray is required, the tray in question may be simply pulled out, on its slides, to the front of the machine. This is only permitted once the main tray 21 has been moved fully to the left and the trays have been lowered from the feed position. In order to load paper, the operator will open the front door, which will break the machine interlock and send a signal by way of the machine logic to the motor which elevates and lowers the tray carriage 10. Energisation of the motor will cause the cable 56 to unwind, allowing the trays to descend under gravity until the tray carriage 10 actuates a down limit switch. When this limit switch is actuated, a signal is sent to the motor 35, causing the main tray 21 to be moved fully to the left. The trays then come to rest, and either one of them can be withdrawn by the operator. The operator will load paper towards the front right-hand corner of the required tray, and set the inboard corner piece 30 or 38 to lock the paper in position. In the front right-hand corner of each tray, there is a registration corner piece, which is moved out of the way whenever the tray is inserted into the machine.

On closing the front door of the machine, the interlock is remade, and on selection of a paper tray, the required tray is moved into the feed position. When the machine is in the standby mode, it is always set to feed paper from the main tray. This is achieved by a time-out feature that resets the machine to the main tray mode if no copies are made within 90 seconds of completing the previous job, A tray interlock system (not shown) is provided to prevent the operator from pulling the trays out of the machine unless they are in the proper position (as described above), or from pulling out both trays together when they are in the proper position.

Figure 4:
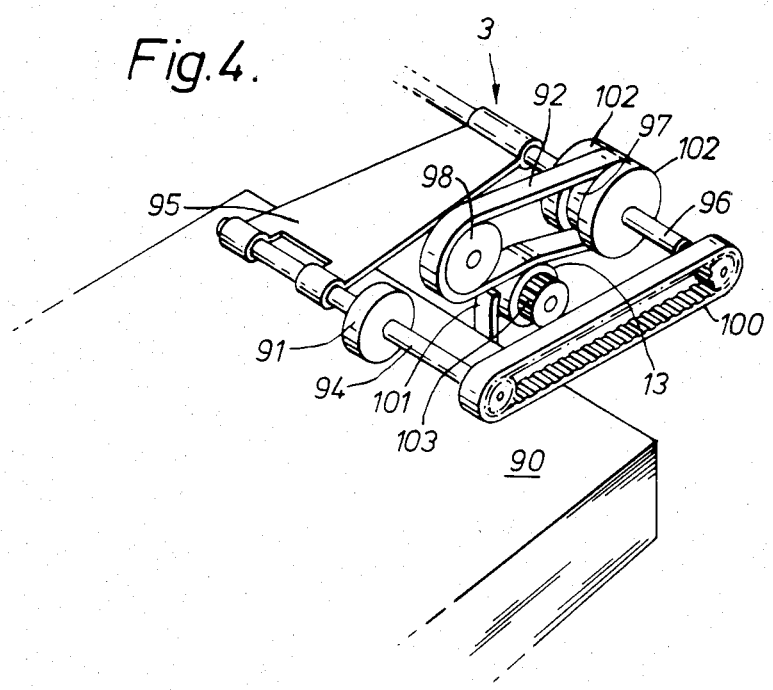
FIG. 4 is a perspective view of a friction retard feeder suitable for use in the apparatus of the invention.

The friction retard feeder 3 will be described with reference to FIG. 4, which is a partial perspective view. Sheets are fed from a stack 90 which is brought, by the positioning of the selected paper tray as already described, into the feeding position. The top sheet in the stack is engaged by a nudger wheel 91, which on rotation feeds the top sheet towards the nip formed between a feed belt 92 and a retard roll 93.

Feeding from the paper trays by the nudger wheel 91 is obtained by creating a stack normal force (of 1.5 newtons) between the nudger wheel and the paper stack. This force is achieved by the weight of the nudger wheel and its associated components acting under gravity. The nudger wheel 91 is mounted on an axle 94 which is mounted for rotation in a suspension arm 95. Suspension arm 95 is in turn mounted for angular motion about shaft 96 that is spaced from the axle 94.

The feed belt 92 is an endless belt arranged around a drive pulley 97 and an idler pulley 98. The belt 92 is deflected from below on its lower run by the retard roll 93.

Drive pulley 97 is secured to the shaft 96 which is driven through a feed clutch on the machine drive system. The axle 94 of the nudger wheel 91 is driven from shaft 96 by means of a toothed belt 100.

As paper is being fed into the system, the paper tray will elevate approximately 1 mm for every 10 sheets of 80 gsm paper being fed. This is sensed by a microswitch (not shown) which is operated by the suspension arm 95 of the nudger wheel, which determines the relative position of the paper stack to the feeder.

At the beginning of a print cycle, the machine logic will interrogate the system to determine if any paper is in the paper path. If there is no paper, the logic will initiate a signal to the feed clutch, thereby starting the feeder system. The nudger wheel 91 will drive the top sheet of paper in stack 90 into the nip between the feed belt 92 and retard roll 93. The feed belt is made of soft rubber material with a high friction surface. As the fed belt 92 rotates it drags a sheet of paper from the stack. Frictional forces and static electricity between the sheets of paper in the stack may cause several sheets to move into the nip together.

If several sheets of paper approach the nip together, the friction between the retard roll 93 and the bottom sheet of those being fed is greater than that between two sheets. The friction between the feed belt 92 and the top sheet is also greater than the friction between two sheets. The group of sheets being fed towards the nip will therefore tend to become staggered around the curved surface of the retard roll up into the nip, until the lower sheet of the top two sheets is retained by the retard roll 93, while the topmost sheet is fed by the feed belt 92. Of course, in order for this to happen, the friction between the feed belt 92 and a paper sheet must be greater than the friction between a paper sheet and the retard roll 93. Therefore the feed belt 92 drives the top sheet away from the stack, and the next sheet is retained in the nip to be fed next.

A lead-in baffle 101 extends in front of the retard roll 93, and serves both to guide paper into the nip, and to prevent undue wear of the retard roll by sheets fed from the top of the stack by the nudger wheel.

The feed clutch remains energised (i.e. the feeder mechanism continues to operate) until paper is sensed by a microswitch located about halfway around the outer guide 4 (FIG. 1). Paper whose leading edge has reached this microswitch is under the control of takeaway rolls that drive the sheet until its leading edge engages registration fingers at the exit of the outer guide 4.

The surface speed of the feed belt 92, at the interface with the retard roll 93, is approximately 120% faster than the machine process speed, but due to friction losses between the belt, paper and retard roll, the paper speed is approximately equal to the process speed. The friction losses are not, of course, constant, since they tend to vary with paper weight, size and surface finish.

In order to obtain a constant speed through the feeder, two drive rolls 102 are carried by shaft 96 on either side of drive pulley 97. Once paper comes under the influence of these rolls, the paper is pulled through the feeder and driven at a constant speed to the takeaway rolls.

To reduce the risk of a "flat" being worn on the retard roll during operation, the retard roll is advanced by 15° every time the paper tray carriage is lowered. This happens, for example, when the front door is opened, during such operations as paper replenishment or jam clearance. A suitable pawl (not shown), which is arranged to move each time the tray carriage is lowered, cooperates with ratched gear teeth 103 moulded on the hub of retard roll 93. Each motion of this pawl causes it to advance the ratchet by one tooth, thereby advancing the retard roll.

Although the apparatus of the invention has been described as having two paper trays, the invention herein applies equally to the case where there are three or more paper trays. In these circumstances, all the trays except the lowermost tray need to be of the kind referred to above as the main tray, i.e. of the kind including a sub-frame and a tray mounted for left-to-right movements across the sub-frame. Furthermore, the lowermost tray (of any number of trays) need not necessarily be of the kind described above as the auxiliary tray. It, too, may be of the same kind as the main tray, with a tray slideably mounted on a sub-frame.

Frictional feeder devices other than the retard feeder described above may be used, for example, frictional feed rollers.

What is claimed is:

1. Sheet feeding apparatus comprising a frame, a tray carriage mounted for vertical movements in the frame, a plurality of tray assemblies for holding respectively a plurality of stacks of sheets, the tray asemblies being carried one above another by the tray carriage and being arranged for independent slideable withdrawal from the tray carriage in a first horizontal direction; and a frictional feeder device in a fixed location for top-feeding sheets in a sheet feed direction from any selected one of the stacks; at least one of the tray assemblies comprising a sub-frame and a tray, the tray being slideably mounted on the sub-frame for movements thereover in a second direction parallel with the sheet feed direction and perpendicular to the first horizontal direction: and wherein the tray of said at least one of the tray assemblies is moved over the subframe by means of a grooved member mounted in the tray carriage and arranged so that the groove in said member is engaged by a catch member mounted on the tray.

2. The apparatus of claim 1 wherein there are two tray assemblies, the uppermost tray assembly being of said kind comprising a sub-frame and a tray slideably mounted thereon.

3. The apparatus of claim 2 wherein said feeder device is a friction retard feeder.

* * * * *